US005348157A

United States Patent [19]

Pozzo

[11] Patent Number: 5,348,157

[45] Date of Patent: Sep. 20, 1994

[54] INFLATABLE PACKAGING CUSHION

[75] Inventor: Michel Pozzo, Neuilly S/Seine, France

[73] Assignee: Ateliers de Conceptions et D'Innovations Industrielles, Courbevoie, France

[21] Appl. No.: 7,857

[22] Filed: Jan. 22, 1993

[30] Foreign Application Priority Data

Jan. 22, 1993 [FR] France ..... 92 00656

[51] Int. Cl.[5] ..... B65D 81/02; B65D 85/30

[52] U.S. Cl. ..... 206/522; 206/588; 206/591

[58] Field of Search ..... 206/522, 588, 589, 591, 206/592; 383/3

[56] References Cited

U.S. PATENT DOCUMENTS

| | | | |
|---|---|---|---|
| 1,457,496 | 6/1923 | Butler | 206/522 |
| 2,977,973 | 4/1961 | Chakine | 206/522 X |
| 3,332,415 | 7/1967 | Ericson | 383/3 X |
| 3,398,501 | 8/1968 | Aninger | 206/522 X |
| 3,889,743 | 6/1975 | Presnich | 206/522 X |
| 3,949,879 | 4/1976 | Peterson et al. | 206/522 |
| 4,180,273 | 12/1979 | Takagi et al. . | |
| 4,198,063 | 4/1980 | Shimizu et al. . | |
| 4,905,835 | 3/1990 | Pivert et al. | 206/522 |
| 4,969,312 | 11/1990 | Pivert et al. . | |
| 5,180,060 | 1/1993 | Forti et al. | 206/522 |

FOREIGN PATENT DOCUMENTS

| | | | |
|---|---|---|---|
| 1043932 | 11/1958 | Fed. Rep. of Germany | 206/522 |
| 3609578A1 | 8/1987 | Fed. Rep. of Germany . | |
| 1269738 | 7/1961 | France | 206/522 |
| 1371316 | 7/1964 | France | 206/522 |
| 2063701 | 7/1971 | France . | |
| 2385606 | 12/1978 | France | 206/522 |
| 2625172 | 6/1989 | France . | |
| 945466 | 1/1964 | United Kingdom | 206/522 |

OTHER PUBLICATIONS

Taschenberg, "Circumferential Seals", Machine Design, 45:27–29, Sep. 13, 1973.

*Primary Examiner*—Bryon P. Gehman

*Attorney, Agent, or Firm*—Jacobson, Price, Holman & Stern

[57] ABSTRACT

Inflatable packaging cushion (100).

According to the invention, the inflatable cushion includes:

an external peripheral edge (101) adapted to the shape and to the dimension of a packing receptacle, at least one internal opening (102, 102') capable of receiving at least one object to be packaged, a plurality of recesses (103, 103') extending from each internal opening towards the peripheral edge, the recesses delimiting in pairs wedging parts (104, 105, 106, 107, 104', 105', 106', 107') capable of coming into contact with the object, zones for preferential pivoting (108) of the wedging parts being defined between the recesses and the peripheral edge, the wedging parts being able to pivot during the inflating about the preferential pivoting zones in order to vary the size and/or the shape of each internal opening and to adapt it to objects of different sizes, whilst exerting a holding pressure on the object or objects.

Application to the packaging of objects of different sizes and/or shapes.

16 Claims, 8 Drawing Sheets

INFLATABLE PACKAGING CUSHION

BACKGROUND OF THE INVENTION

The present invention relates in a general manner to the field of inflatable-cushion packaging.

A packaging item, comprising a rigid box which is, for example, parallelepipedal, against the internal walls of which six inflatable cushions are respectively provided, is known, especially from Patents FR-A-2,063,701 or FR-A-2,625,172. Each cushion or group of cushions includes an inflating pipette which can possibly pass through a perforation formed in the equivalent face of the box so as to enable the said cushion or group of cushions to be inflated from the outside.

An object to be packaged is thus, after inflating, intimately wedged between the internal faces of the cushions which, by their deformability, adapt to the shape and/or size of the said object.

Thus, such a packaging item can be used for packaging articles of various dimensions and shapes by suitably wedging them each time.

However, such a known packaging item has several drawbacks.

On the one hand, the correct positioning of the cushions or groups of cushions, in the deflated or semi-inflated state, can turn out to be irksome.

On the other hand, in order for the cushions to be able to adapt easily to objects of different sizes, it is desirable to impart particular profiles to them, for example trapezoidal profiles, which complicates their manufacture.

Finally, it may be noted that such a known packaging item has to include a box which is special in the sense that it must be provided with at least one perforation enabling a pipette to pass, for inflating from outside.

SUMMARY OF THE INVENTION

In order to alleviate the various drawbacks of the prior art, the present invention provides an inflatable cushion which is easy to produce and which makes it possible to wedge one or more objects to be packaged suitably in any rigid box, the installation of the said inflatable cushion and of the object into the box being easy and rapid. Another object of the invention is to provide a packaging item comprising an ordinary box and at least one cushion, the inflating of which can be carried out easily from outside the box after closing it without any particular arrangement of the box being necessary.

More particularly, the invention relates to an inflatable packaging cushion, including:

- an external peripheral edge adapted to the shape and to the dimension of a packing receptacle,
- at least one internal opening capable of receiving at least one object to be packaged,
- a plurality of recesses extending from each internal opening towards the peripheral edge, the said recesses delimiting in pairs wedging parts capable of coming into contact with the object, zones for preferential pivoting of the wedging parts being defined during the inflating between the said recesses and the peripheral edge, the said wedging parts being able to pivot about the preferential pivoting zones in order to vary the size and/or the shape of each internal opening and to adapt it to objects of different sizes and/or shapes, whilst exerting a holding pressure on the object or objects.

Thus, the inflatable cushion according to the invention, advantageously being made as a single piece, easily makes it possible, after inflating, to wedge one or more objects to be packaged intimately between the internal faces of the said wedging parts which, by their pivoting, adapt to the shape of one or more said objects.

According to a preferred embodiment of the inflatable cushion according to the invention, each internal opening has a rectangular shape, the said recesses extending from each of the corners of each rectangle towards the peripheral edge of the said cushion and thus delimiting in pairs four wedging parts per opening, which are capable of coming into contact with the object to be packaged.

Thus, the internal opening has a shape which is well suited to receive one or more fragile objects of essentially parallelepipedal shape.

Furthermore, as the packaging receptacles intended to receive the inflatable cushion according to the invention, themselves most often have parallelepipedal shapes, it is particularly recommended that, in the deflated state, the external peripheral edge of the said cushion essentially describes a rectangle, each internal opening being placed in such a manner that at least some of the recesses extend in the direction of the corners of the said peripheral edge.

Thus the cushion according to the invention in the deflated or semi-inflated state and the object to be packaged are easily and rapidly installed in a parallelepipedal packing box. Afterwards, the inflating of the said cushion, placed inside the box, is stopped when the object to be packaged is suitably gripped by the said wedging parts and when the latter form damping parts between the object and the lateral walls of the packing box.

Another object of the present invention is to provide a packaging item comprising a box made of rigid cardboard or the like, at least one inflatable cushion according to the invention and at least one other inflatable cushion placed above or below at least one object to be packaged.

According to the invention, this other inflatable cushion, especially for such a packaging item comprising a box provided with at least one articulated closure flap, one edge of which is adjacent to a corner of the box, includes a self-sealing inflating valve located in a corner region of the said cushion, the said inflating valve being placed, when the said cushion is installed in the box, in the region of the corner, which enables the said cushion to be inflated from outside, after closing the said flap, by means of an inflating hose inserted into the said inflating valve and passing via a space located between the articulated closure flap and at least one face of the box adjacent to the corner.

Thus, advantageously, this other inflatable cushion, according to the invention, can be inflated from outside when the packing box is closed, without the latter including particular perforations for enabling the inflating hose to pass, which enables all packing boxes having articulated closure flaps, existing on the packaging market, to be used.

Moreover, the invention also relates to a method for packaging at least one article with the aid of the previously described packaging item and including a box, one opening of which can be closed by articulated flaps, comprising the steps consisting in:

a) placing at least one first inflatable cushion according to the invention, in the deflated or semi-inflated state, as well as the article or articles, inside the box via its opening, the article or articles being located in each internal opening of each cushion, b) stopping the inflating of the said cushion and then arranging in the box at least one other inflatable cushion according to the invention, in the deflated or semi-inflated state, an inflating hose being inserted into the self-sealing valve of the said inflatable cushion, c) closing the flaps of the box in such a way that the said inflating hose emerges outside the said box through the space located between a flap and at least one face of the box, d) inflating the said cushion from outside the box.

In addition, so as better to protect the object to be packaged, the method according to the invention comprises a preliminary step consisting in arranging another cushion in the said box.

BRIEF DESCRIPTION OF THE DRAWINGS

Other aspects and advantages of the present invention will become clearer on reading the following detailed description of a preferred embodiment of the latter, given by way of example and given with reference to the attached drawings, in which.

It will be preliminarily noted that, from one figure to another, identical or similar elements or parts have been designated, insofar as possible, by the same reference symbols and will not be described every time.

DETAILED DESCRIPTION OF THE PREFERRED EMBODIMENTS

Figure 1:
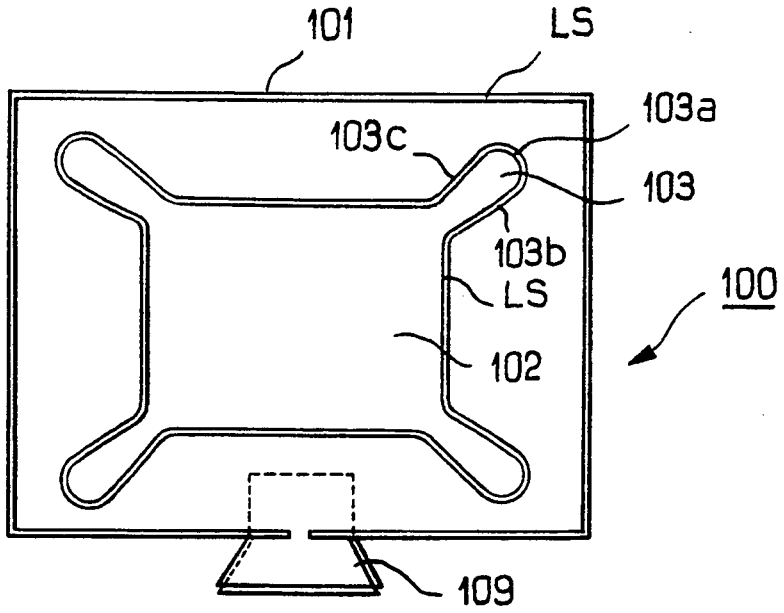
FIG. 1 is a plan view of a first embodiment of an inflatable cushion in accordance with the invention, in the deflated state.
Figure 2:
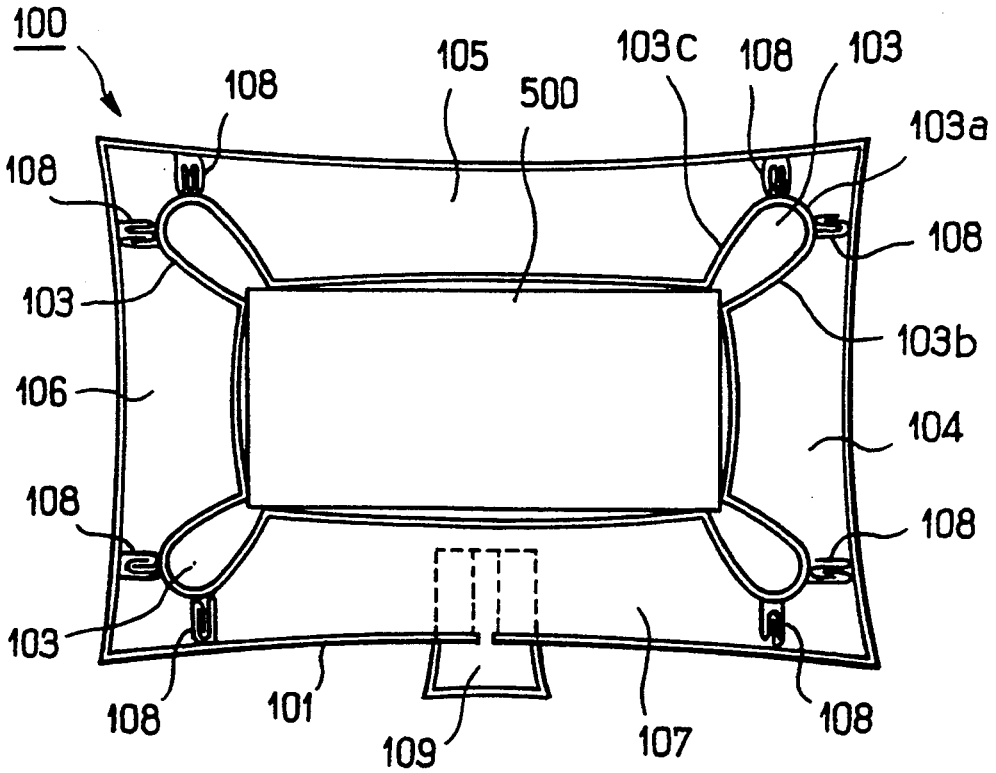
FIG. 2 is a plan view of the inflatable cushion of FIG. 1, in the inflated state.
Figure 3:
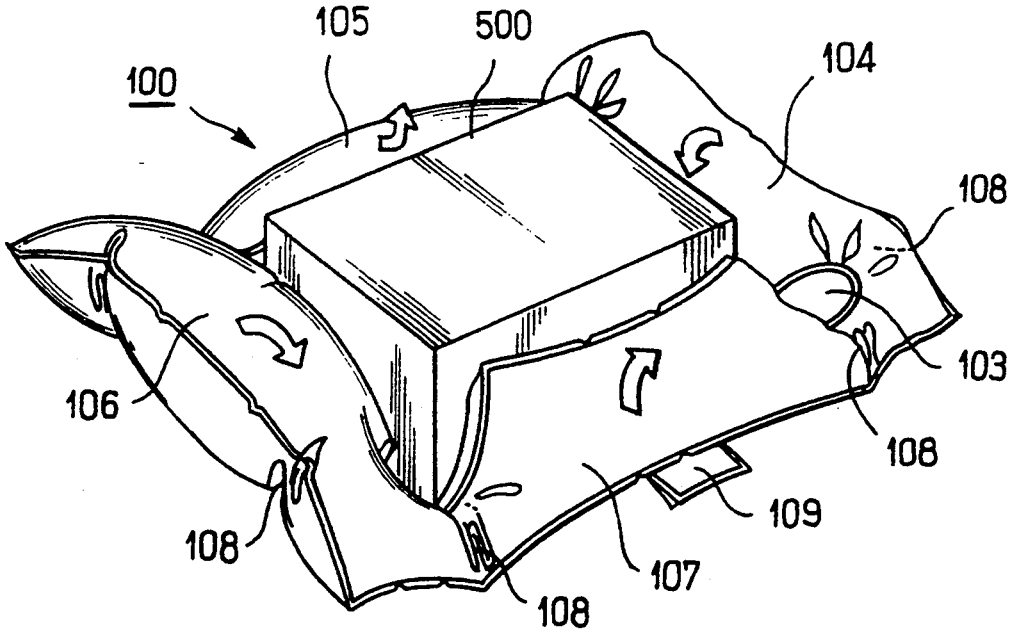
FIG. 3 is a perspective view of the inflatable cushion of FIG. 1, in the inflated state.

First of all referring to FIGS. 1, 2 and 3, these show a first embodiment of an inflatable packaging cushion 100 in accordance with the invention, intended to wedge and to protect one or more objects to be packaged.

As may be seen in these figures, this inflatable cushion 100 includes an external peripheral edge 101 which here describes essentially a rectangle and which is generally adapted to the shape and to the dimension of a packaging receptacle, for example a box made from rigid cardboard or the like. Moreover, this inflatable cushion 100 includes an internal opening 102, which is rectangular for example, capable of receiving at least one object 500 to be packaged and a plurality of recesses 103, here four recesses 103 extending from each of the corners of the rectangular internal opening 102 towards the peripheral edge 101 of the said cushion 100 and more precisely in the direction of the corners of the said peripheral edge 101. According to the embodiment shown in FIGS. 1, 2 and 3, the inflatable cushion 100 consists of two sheets of flexible plastic, here poly(ethylene-vinyl acetate), juxtaposed and welded together in the region of their edges along the welding lines LS.

It will be noted that the poly(ethylene-vinyl acetate) is a particularly advantageous material as, on the one hand, it is sufficiently flexible to adapt to the contours of the object to be packaged and, at the same time, sufficiently robust not to be pierced by possible highly projecting or pointed parts of the object and, on the other hand, it can be incinerated, without release of toxic vapour, or can be recycled.

As may be better seen in FIGS. 2 and 3, the recesses 103 delimit, in pairs, wedging parts 104, 105, 106, 107, here four wedging parts capable of coming into contact with the object 500 to be packaged, by pivoting, as will be seen later, around preferential pivoting zones 108 defined between the said recesses 103 and the peripheral edge 101.

According to the invention, the pivoting of the said wedging parts 104, 105, 106, 107 around the preferential pivoting zones 108 enables the size and/or the shape of the internal opening 102 to be varied in order to adapt it to objects of various sizes and/or shapes, whilst exerting a holding pressure on the object or objects to be packaged by virtue of a return movement which is exerted in the region of the pivoting zones 108. In this case, the shape of each recess 103 and/or of the peripheral edge 101 is such that, in this region, two preferential pivoting zones 108 located respectively at two locations where the space between the said recess 103 and the external peripheral edge 101 of the said cushion 100 is the least. In this example, as may be seen in the three figures in question, the peripheral edge 101 is substantially straight between two corners and each recess 103 is substantially droplet shaped, that is to say has a shape constituted by two lines 103*b*, 103*c* diverging from a corner of the internal opening 102 towards the peripheral edge 101 and joined together by a rounded portion 103*a* in the vicinity of this edge.

It is observed that, in the region of the rounded portion 103*a*, there are two locations where the space between the said recess 103 and the said external peripheral edge 101 is the least and these two locations define two preferential pivoting zones 108. Of course the shapes of the said recesses 103 and/or of the peripheral edge 101 which are described are not unique and the person skilled in the art will be able to make his modifications to them, knowing that it suffices to create, between one recess 103 and the peripheral edge 101, at least one narrowing so as to define at least one preferential pivoting zone 108.

For example, it is possible to envisage the external peripheral edge 101 having indentations in the region of each recess 103 in order to define, with the said recess, the preferential pivoting zones 108.

Moreover, as may be better seen in FIG. 3, the shape and the dimension of the recesses 103 and of the peripheral edge 101 are such that, during the inflating, two neighbouring wedging parts spontaneously pivot in opposite directions, this spontaneous pivoting being due in particular to the fact that the inflating of the cushion will generate certain tensions in its material, especially in the neighbouring region of the recesses, and that these tensions are at a minimum after such a pivoting has occurred.

It will be noted advantageously that, according to the embodiment shown in FIG. 3, the four lateral intersecting edges of the object 500 placed in the inflatable cushion 100 are engaged in the said recesses 103; they are therefore not in contact with the cushion, which minimizes the risk of wear or of deterioration of the cushion by these intersecting edges. The said recesses moreover constitute, by virtue of their deformability, preferential impact-damping zones.

The inflatable cushion 100 shown in FIGS. 1, 2 and 3 has a self-sealing inflating valve 109 located on one side of the peripheral edge 101, enabling the said cushion to be inflated or deflated by means of an inflating hose which is inserted into the said valve. It should be specified that this inflating valve 109 can be placed equally on any edge of the said cushion 100 and, for example, on the edge of the internal opening 102, emerging naturally towards the interior of the said opening.

Figure 4:
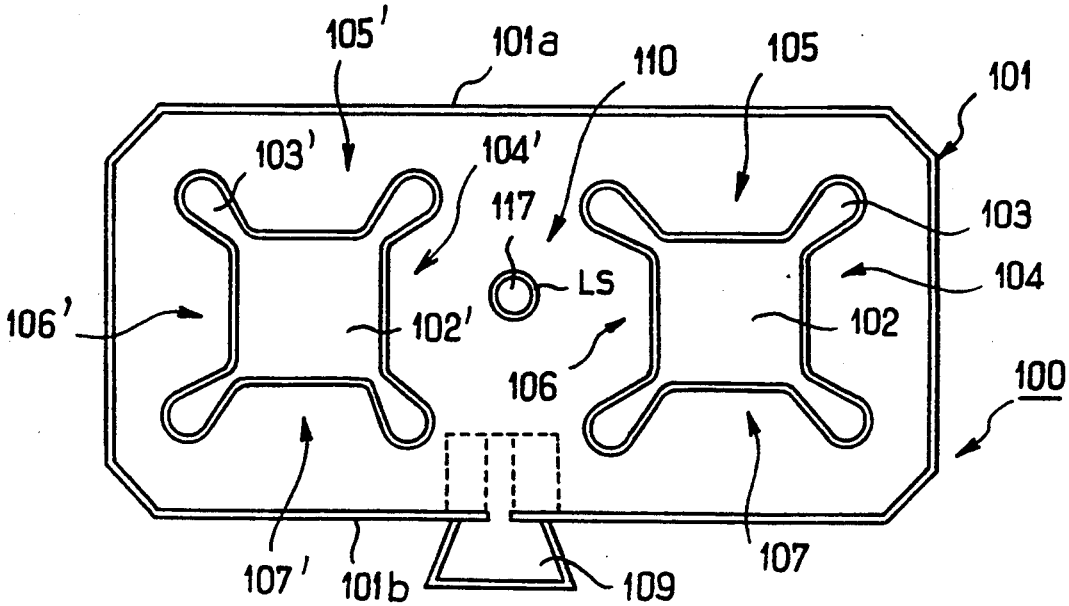
FIG. 4 is a plan view of a first alternative embodiment of the inflatable cushion of FIG. 1, in the deflated state.

FIG. 4 shows an alternative embodiment of the inflatable cushion 100 of FIG. 1, which here includes two internal openings 102, 102' of square shape. Furthermore, it comprises eight recesses 103, 103' which extend from each of the corners of each square internal opening 102, 102' towards the peripheral edge 101 of the said cushion 100. Here, the cushion includes four flats bevelled at the four corners. The internal openings 102, 102' are placed such that each opening 102, 102' comprises two recesses 103, 103' extending in the direction respectively of two corners of the said peripheral edge 101 and two recesses 103, 103' extending respectively towards the centers of the longitudinal parts 101*a*, 101*b* of the peripheral edge 101. The cushion 100 shown in FIG. 4 then comprises eight pivoting wedging parts 104, 105, 106, 107, 104', 105', 106', 107', each defined by two successive recesses, the said wedging parts being capable of coming into contact with one or more objects to be packaged. Moreover, as may be seen in FIG. 4, the cushion 100 comprises a fixed central wedging part 110 which extends between the said openings 102, 102' and which includes a central hole 117, produced by cutting the two sheets forming the cushion and welding the cut edges of the said sheets along the line LS. This circularly-shaped central hole makes it possible to act as an impact-absorbing buffer when the said cushion is placed between the face of a packing box and an object to be packaged. In addition, this circular hole 117 enables the thickness of the cushion in the inflated state to be limited.

Figure 5:
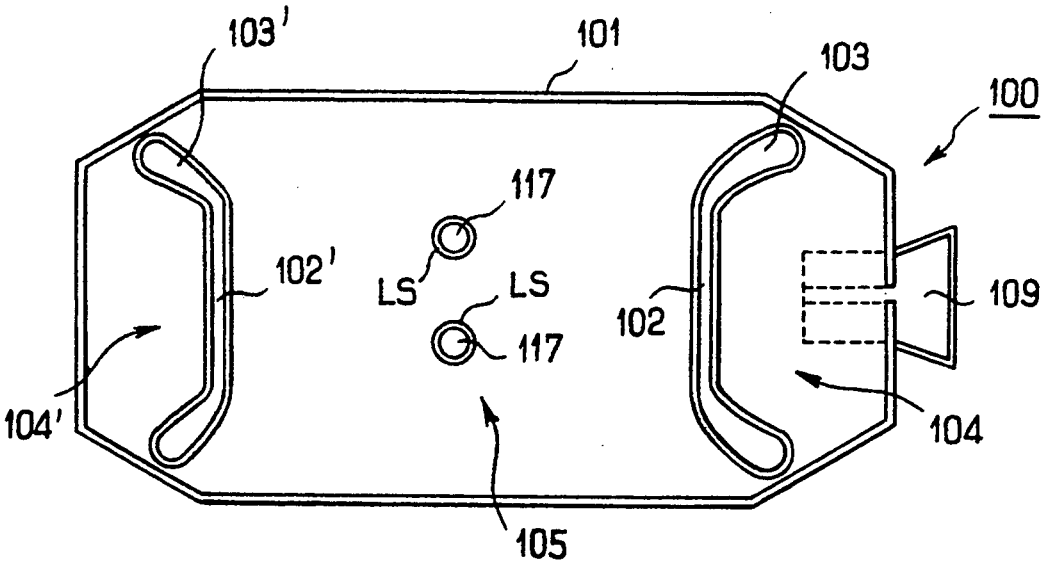
FIG. 5 is a plan view of a second alternative embodiment of the inflatable cushion of FIG. 1, in the deflated state.

FIG. 5 shows another alternative embodiment of the inflatable cushion 100 of FIG. 1, which includes two internal openings 102, 102' each having an essentially straight shape. The internal openings 102, 102' arranged in parallel have a recess 103, 103' at each end. The cushion 100 then includes four recesses 103, 103', each of the recesses extending in the direction of a corner of the peripheral edge 101. Furthermore, the cushion 100 comprises three wedging parts 104, 104', 105. Two of the wedging parts 104, 104' can pivot and each is delimited by the two recesses 103, 103 ' extending from the said openings. The third wedging part is a fixed central part 105 lying between the two openings 102, 102'. Moreover, the cushion 100 includes at the center of the central wedging part 105, two circular holes 117 which, as has already been explained, makes it possible to limit the thickness of the inflated cushion and to act as an impact absorber. In the same manner as for the cushion of FIG. 4, the four corners of this cushion have a bevelled flat.

Figure 6:
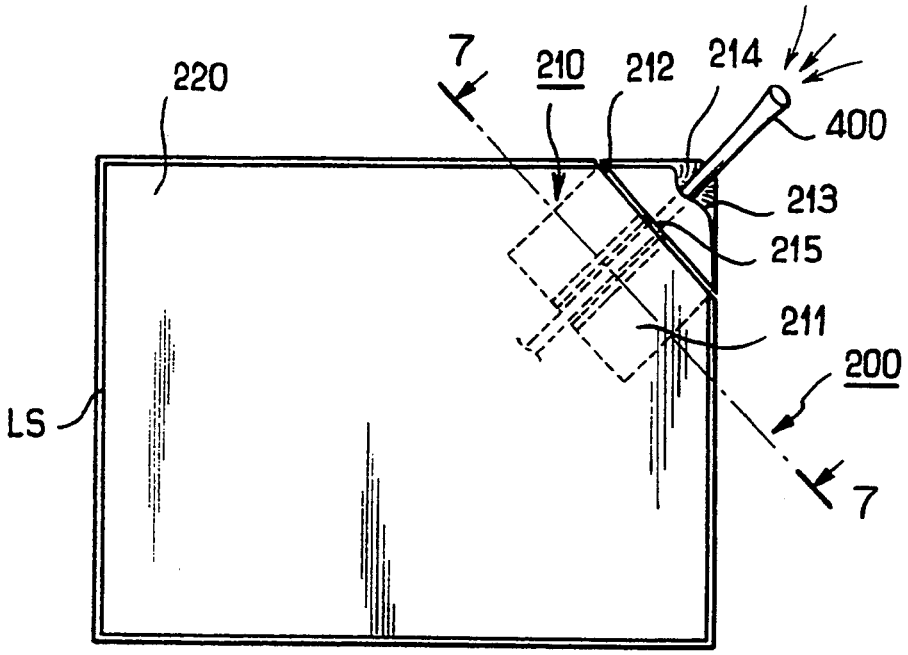
FIG. 6 is a plan view of an inflatable cushion according to the invention, in the deflated state, comprising a self-sealing valve in a corner.

Referring to FIG. 6, this shows another inflatable cushion 200 in accordance with the invention. This other inflatable cushion 200 is especially intended to be inserted into a packaging item in accordance with the invention, shown in FIG. 10, and comprising, in particular, a box 10 provided with articulated closure flaps adjacent, by one of their edges, to a corner of the box, as well as an inflatable cushion 100 of the type shown in FIGS. 1, 2, 3, 4 and 5. Two of the flaps are designated by the references 303 and 304.

According to the embodiment of FIG. 6, the inflatable cushion 200 consists of two sheets 220 of flexible plastic, for example poly(ethylene-vinyl acetate) welded together in the region of their edges along the welding line LS. As may be seen in FIG. 6, the inflatable cushion 200 has a rectangular shape adapting to the shape and to the dimension of the box 10. This cushion shape is the preferred shape knowing that most packing receptacles have essentially parallelepipedal shapes.

Moreover, the inflatable cushion 200 advantageously includes a self-sealing inflating valve 210 located in a corner region of the said cushion 200. Thus, when the latter is installed in the box 10, the said inflating valve 210 is placed in the region of a corner 300 of the box, which enables the said cushion 200 to be inflated from outside, after closing the articulated flaps, by means of an inflating hose 400 inserted into the said valve 210 and passing via a pace located between the flaps 303 and 304 and the faces 301, 302 of the box which are adjacent to the said corner 300. This inflating characteristic is very significant as it enables a packing box having flaps to be used without any particular arrangement for allowing the said hose to pass.

Figure 7:
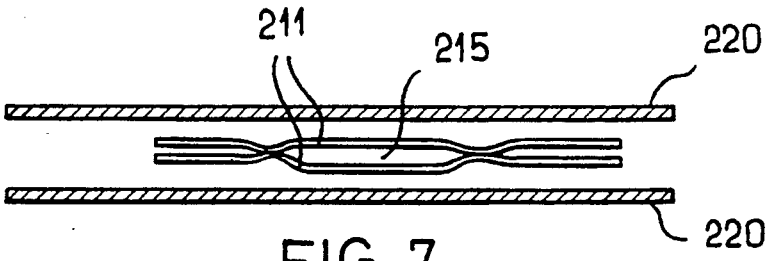
FIG. 7 is a sectional view along line A–A' of the self-sealing valve in a corner of the inflatable cushion of FIG. 6.
Figure 8A:
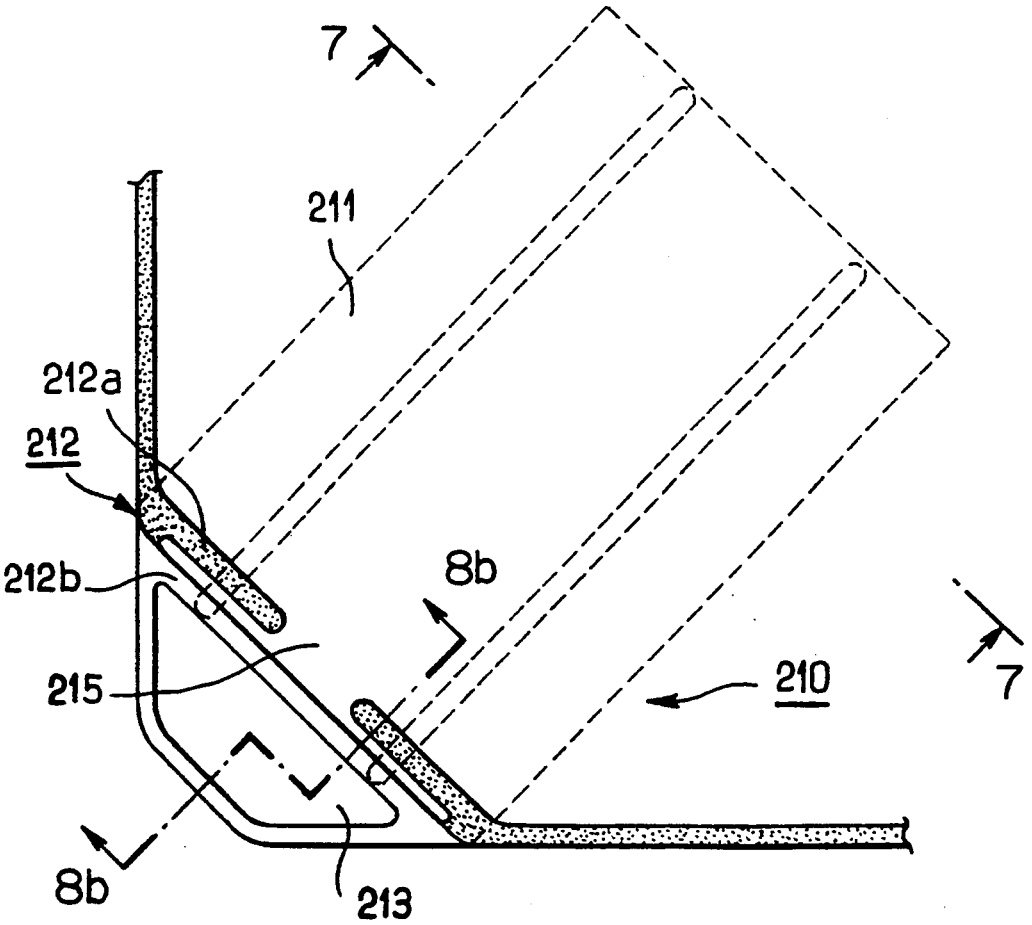
FIG. 8*a* is a detailed view of the self-sealing valve in a corner and of two tabs for guiding the inflatable cushion of FIG. 6.
Figure 8B:
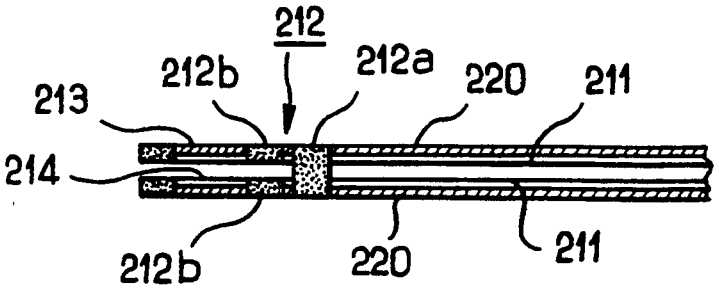
FIG. 8*b* is a sectional view along line B–B' of the valve and of the two tabs of FIG. 8*a*.

As may be seen in FIGS. 6, 7 and 8*a*, the self-sealing inflating valve 210 comprises two thin sheets 211 of plastic juxtaposed and welded together along two parallel lines so as to form a passage conduit for the inflating hose 400, open at both ends. As may be better seen in FIG. 7, the inflating valve 210 is located between the two sheets 220 forming the said cushion 200 in the corner region of the said cushion. Furthermore, the said valve, as FIG. 6 shows, extends from a corner of the cushion only along a part of the length of one diagonal of the cushion, which enables the cushion to be deflated by inserting the hose 400 into the valve beyond the free end of the passage conduit.

Figure 9:
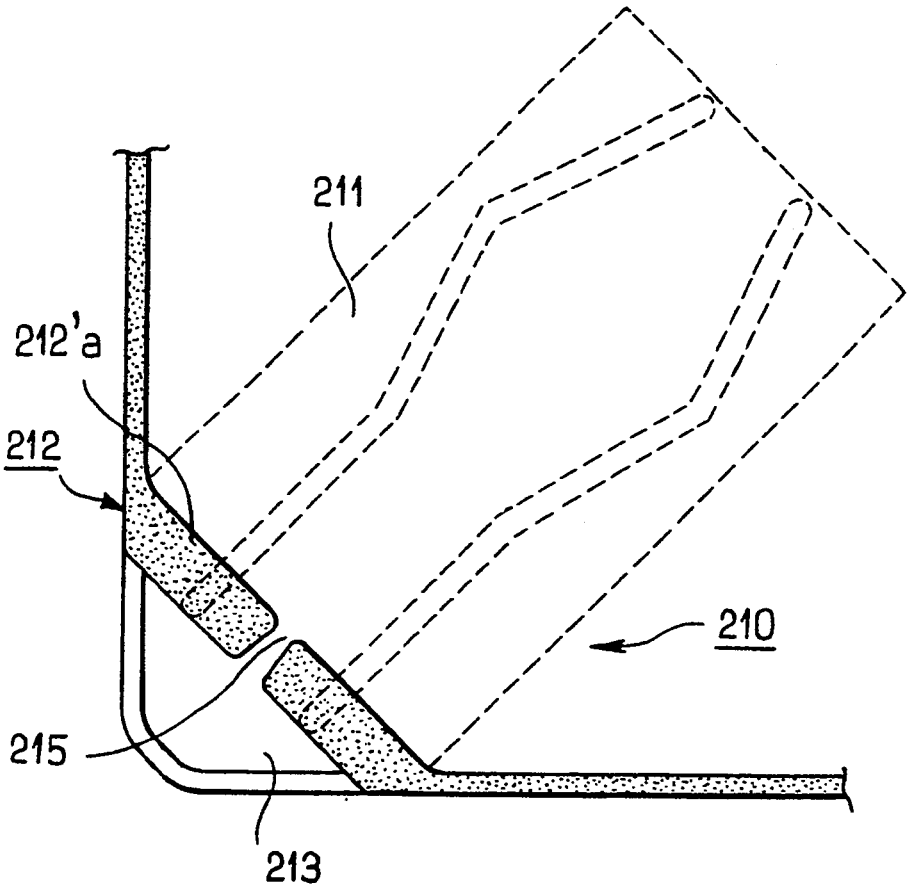
FIG. 9 is a detailed view of an alternative embodiment of the self-sealing valve of FIG. 6.

According to a variant of the self-sealing inflating valve 210 shown in FIG. 9, the parallel welding lines of the two thin sheets 211 move apart locally such that the passage conduit for the inflating hose created by the said lines includes a widening located some distance from the free end of the said conduit placed inside the cushion 200.

Thus, advantageously when the inflating of the said cushion 200 is stopped and when the hose 400 is still partially engaged in the passage conduit, the two thin sheets 211 are applied mutually against each other by virtue of a distortion caused in the vicinity of the free end of the said conduit by the said widening, so as immediately to obstruct the conduit and thus prevent the said cushion from partially deflating.

In addition, as FIGS. 6, 8*a*, 8*b* and 9 show, the sheets 211 are welded together at one of their ends and at the two sheets 220 forming the cushion along a welding line 212*a* extending along a bevelled flat 212 of the corner of the cushion, thereby leaving a non-welded zone in line with an adjacent opening 215 of the conduit in order to allow the conduit to be open to the outside for inserting the inflating hose 400.

In order to facilitate the insertion of the hose into the conduit, there is provision, as may be seen in FIGS. 6, 8*a*, 8*b* and 9, for the inflatable cushion to include two flexible guide tabs 213, each of which is constituted by the prolongation, in superposition, of a sheet 220 of the cushion and of a sheet 211 of the valve. According to the embodiment shown more particularly in FIGS. 8*a* and 8*b*, a peripheral weld 212*b*, separate from the welding line 212*a* along the bevelled flat 212, firmly attaches these sheets together and has edges located in the prolongation of the adjacent edges of the cushion 200. More precisely, as may be seen in FIGS. 8*a*, 8*b* and 9, the end of the inflating valve is welded to the cushion 200 along a welding line 212*a*, this weld linking, on the one hand, the two thin sheets 211 and the two sheets 220 constituting the said cushion. According to the alternative embodiment shown in FIG. 9, a single welding line 212*a*′ can be seen, which extends along the bevelled flat 212 and which makes it possible, on the one hand, to weld together the sheets forming the self-sealing valve and to weld them to the sheets forming the cushion, and, on the other hand, to firmly attach the sheets constituting the guiding tabs to the said cushion. It will be noted that the welding line 212*a*′ has a width markedly greater than that of the single welding line 212*a*. This allows the possible inscription, within the said welding line 212*a*′, of a mark or of any specification relating to the said cushion.

In this regard, it should be specified that the inflatable cushions 100 according to the invention, shown in FIGS. 1, 2, 3, 4 and 5, can themselves also include, if necessary, a self-sealing inflating valve in a corner, according to the embodiments shown more particularly in FIGS. 7, 8*a*, 8*b* and 9.

Figure 11:
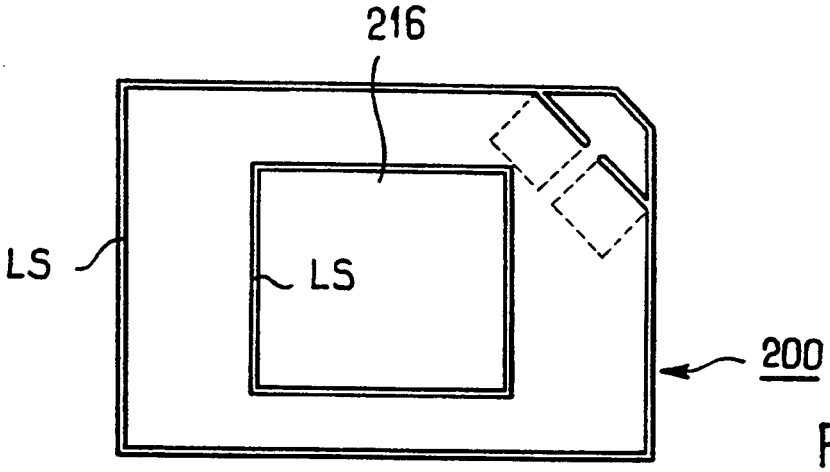
FIG. 11 is a plan view of a variant of the inflatable cushion of FIG. 6.
Figure 12:
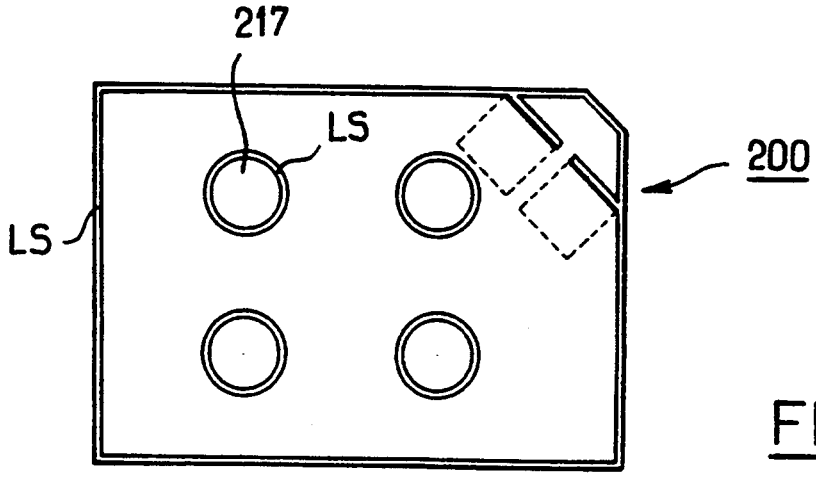
FIG. 12 is a plan view of another variant of the inflatable cushion of FIG. 6.

Referring to FIGS. 11 and 12, these show two other embodiments of the inflatable cushion 100 equipped with a corner valve. As may be seen in FIG. 11, the inflatable cushion 200 includes a central hole 216 produced by cutting the two sheets 220 forming the cushion and welding the cut edges of the said sheets along the welding line LS. This central hole, here of rectangular shape, advantageously enables the cushion to contribute to the wedging of the objects to be packaged.

According to the embodiment shown in FIG. 12, the inflatable cushion 200 includes four circular holes 217 produced by cutting the said sheets 220 and welding along the welding lines LS. Advantageously, these circular holes 217 enable the thickness of the cushion to be limited in the inflated state and act as impact-absorbing buffers when the said cushion is placed between the face of a packing box and an object to be packaged.

Figure 10:
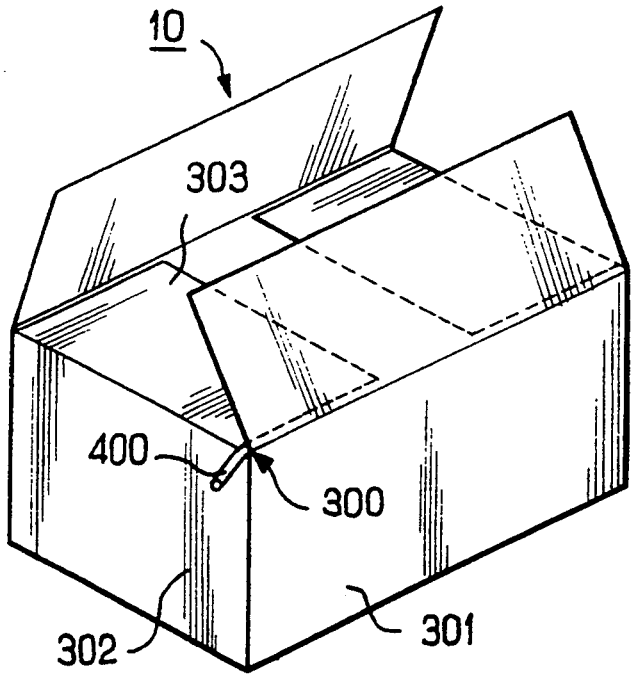
FIG. 10 is a perspective view of a box for a packaging item according to the invention.

Furthermore, the packaging item of the type shown in FIG. 10 includes an ordinary box 10 made from rigid cardboard or the like, provided with articulated closure flaps and for example:

- a first inflatable cushion 200 of the type shown in FIGS. 6 and 11 or 12, at the bottom of the box 10, above this cushion 200, the object 500 to be packaged held in an inflatable cushion 100 of the type shown in FIGS. 1, 2 and 3, in the inflated state,
- a second inflatable cushion 200 of the type shown in FIGS. 6 and 11 or 12 placed above the object 500 to be packaged, in the deflated or semi-inflated state. The latter cushion is inflated, after closing the articulated flaps of the box 10, by means of the hose 400 inserted into the corresponding inflating valve 210 and passing through the box in the region of one of its corners, between the flaps 303, 304 and the lateral faces 301, 302.

Figure 14:
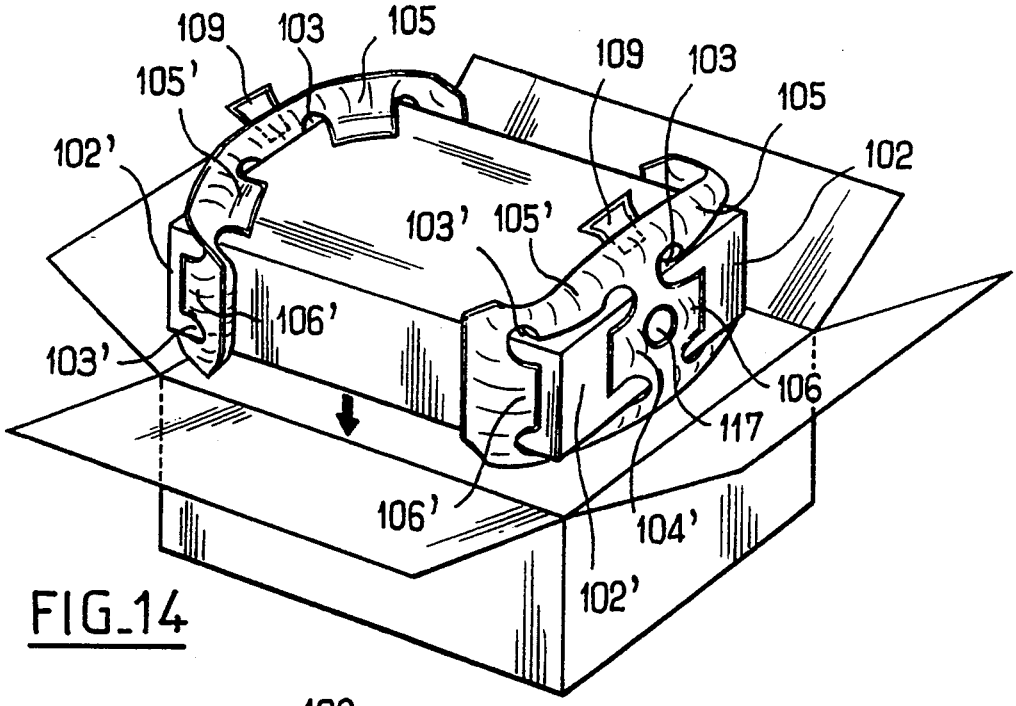
FIG. 14 illustrates a packaging item comprising a box and two inflatable cushions of the type illustrated in FIG. 4.

According to a second example illustrated in FIG. 14, the packaging item of the type shown in FIG. 10, includes only two inflatable cushions 100 of the type shown in FIG. 4 in the inflated state, each inflatable cushion 100 being positioned in such a manner that each fixed central wedging part 110 is placed against a lateral face of the object 500 to be packaged, each associated opening 102, 102′ being obliquely positioned with respect to the said corresponding fixed central wedging part 110 such that each corner of the said object 500 is engaged in an opening 102, 102′, the four wedging parts 104, 105, 106, 107, 104′, 105′, 106′, 107′ associated with each opening 102, 102′ pivoting so that one of the wedging parts is positioned against the upper face of the object 500, another wedging part is positioned against the lower face of the said object 500 and the two other wedging parts are positioned against two adjacent lateral faces of the said object.

Figure 15:
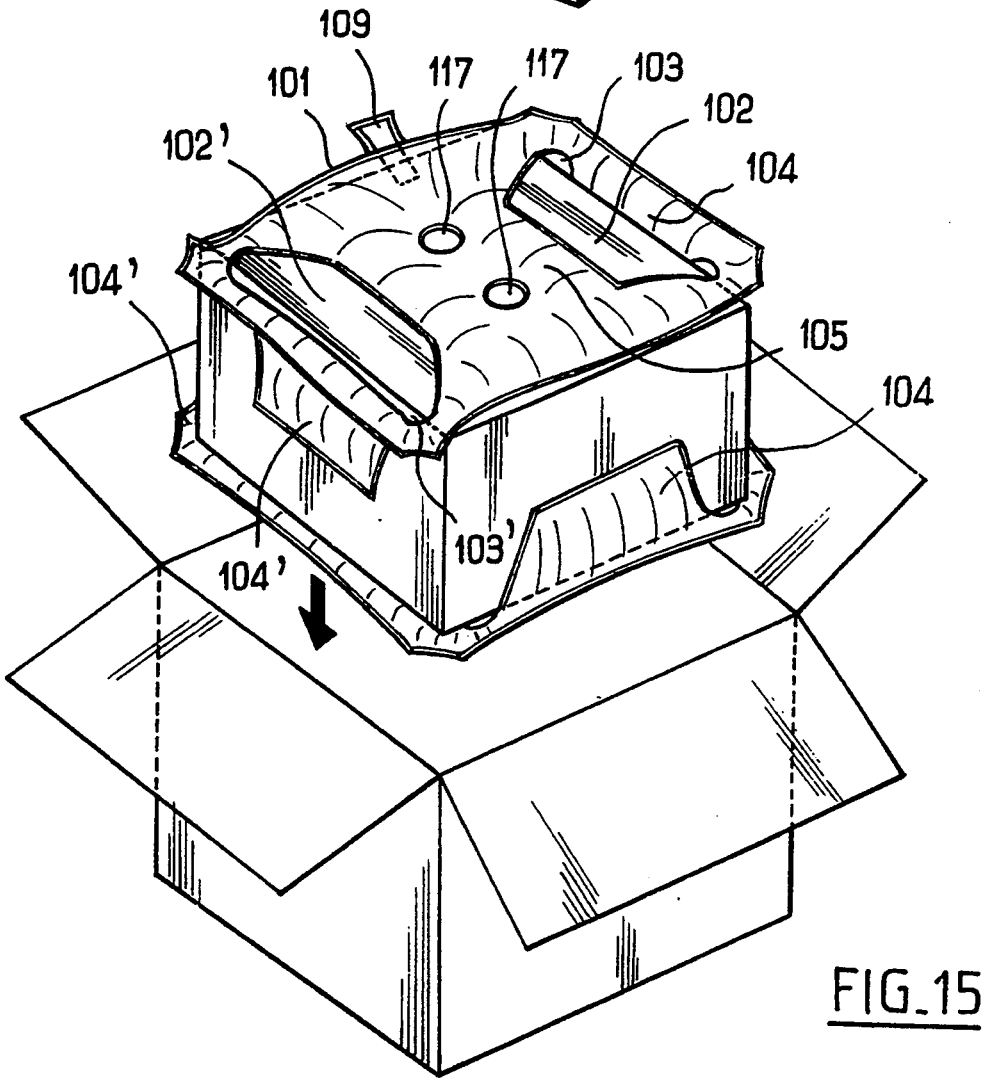
FIG. 15 illustrates a packaging item comprising a box and two inflatable cushions of the type illustrated in FIG. 5.

According to a third example illustrated in FIG. 15, the packaging item of the type shown in FIG. 10 includes only two inflatable cushions 100 of the type shown in FIG. 5, a first inflatable cushion 100 being positioned in the inflated state under the object 500 to be packaged in such a manner that the said fixed central wedging part 105 is placed against the lower face of the said object 500, the said wedging parts 104, 104′ associated with the two openings 102, 102′ pivoting so as to be placed against each of the two opposing lateral faces of the said object 500 so that the parallel lower transverse intersecting edges of the said object engage in the said openings 102, 102′, the second inflatable cushion 100 being positioned in the inflated or semi-inflated state above the object to be packaged in such a manner that the fixed central wedging part 105 is positioned against the upper face of the said object 500, the said wedging parts associated with the two openings pivoting in such a manner as to be placed against each of the two other opposing lateral faces of the object so that the parallel upper longitudinal intersecting edge of the latter engage in each of the said openings of the said cushion.

Figure 13:
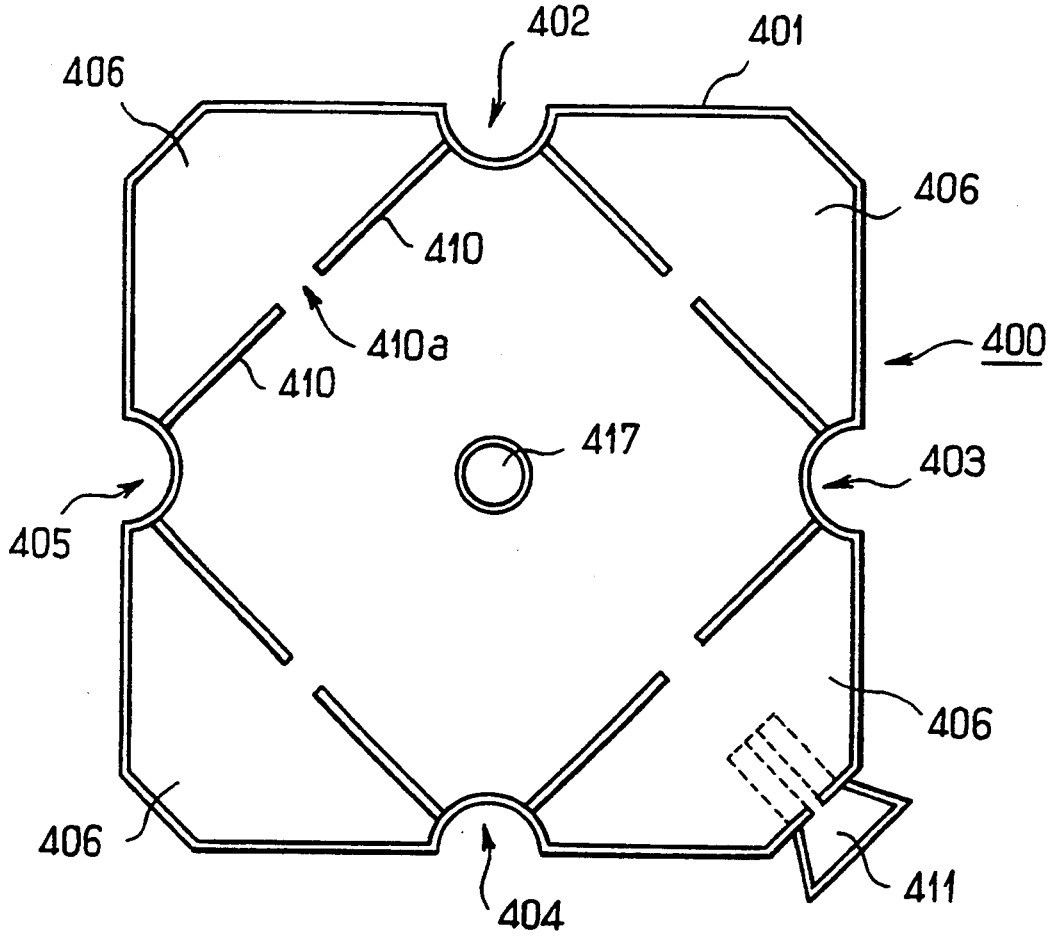
FIG. 13 is a plan view of another cushion according to the invention, in the deflated state.

FIG. 13 shows another inflatable cushion 400 according to the invention. This inflatable cushion 400, constituted by sheets made from flexible plastic welded together in the region of their edges, includes:

- an external peripheral edge 401 which has four bevelled flats at the four corners, a plurality of recesses 402, 403, 404, 405 extending towards the interior of the cushion 400 from the peripheral edge 401, a plurality of welding lines 410 extending from each recess in the direction of the adjacent recess, an articulated wedging part 406 being jointly defined by a welding line 410, parts of each associated recess 402, 403, 404, 405 and the peripheral edge 401. The articulated wedging parts 406 have an essentially trapezoidal shape. Furthermore, each articulated wedging part 406 communicates with the rest of the cushion via a discontinuous part 410*a* of each welding line 410. These discontinuous parts 410*a* of the welding lines 410 are located at the center of the latter. In addition, the articulated wedging parts 406 pivot substantially about the said welding lines 410. It will be noted that the said recesses 402, 403, 404, 405 of the inflatable cushion 400 have a semicircular shape. Moreover, FIG. 13 shows that the cushion 400 includes a central hole 417 of circular shape acting as an impact-absorbing buffer and enabling the thickness of the cushion to be limited in the inflated state. The cushion 400 also comprises a self-sealing valve 411 located in a corner region of the said cushion 400. This valve 411 is of the type shown in FIGS. 8*a* or 9.

The invention advantageously applies to the transporting and to the handling of any fragile merchandise, and especially electronic, computer or other equipment, with the ability to use a single type of packaging for a whole range of products and to be able to reuse it several times.

Of course, the present invention is in no way limited to the embodiment described and shown, but the person skilled in the art will know how to make any variant thereof in accordance with its scope.

I claim:

1. Inflatable packaging cushion comprising:

an external peripheral edge adapted to the shape and to the dimension of a packing receptacle, at least one internal opening capable of receiving at least one object to be packaged such that a side of said at least one object is completely encircled by the perimeter of said at least one internal opening, a plurality of recesses extending from each internal opening towards the peripheral edge, said recesses delimiting in pairs wedging parts capable of coming into contact with said at least one object, zones for pivoting of the wedging parts being defined between the recesses and the peripheral edge, said wedging parts being arranged so as to automatically pivot during inflation of the inflatable packaging cushion about a line extending generally between two successive recesses in order to vary the size and the shape of each internal opening and to adapt it to objects of different sizes, whilst exerting a holding pressure on said at least one object, said internal opening being completely encircled by said wedging parts.

2. Inflatable cushion according to claim 1, characterized in that each internal opening has a rectangular shape, the said plurality of recesses extending from each of the corners of each rectangle towards the peripheral edge of the said cushion and thus delimiting in pairs four wedging parts per opening, which are capable of coming into contact with said at least one object to be packaged.

3. Inflatable cushion according to claim 2, characterized in that the shape of each recess and of the peripheral edge defines two pivoting zones located respectively at two locations where the space between each of said plurality of recesses and the external peripheral edge of the said cushion is smallest.

4. Inflatable cushion according to claim 2, characterized in that the shape and the dimension of the recesses and of the peripheral edge is such that, during inflation of the inflatable cushion, two facing wedging parts pivot in opposite directions.

5. Inflatable cushion according to claim 2, characterized in that, in the deflated state, the external peripheral edge substantially describes a rectangle, each internal opening being placed in such a manner that at least some of the recesses extend in the direction of the corners of the said peripheral edge.

6. Inflatable cushion according to claim 1, characterized in that each internal opening has an elongated shape, the said recesses extending from each of the ends of each internal opening towards the peripheral edge of the said cushion and thus delimiting in pairs one wedging part per opening, which is capable of coming into contact with said at least one object to be packaged.

7. Inflatable cushion according to claim 1, characterized in that each of said plurality of recesses has a width which increases, at least locally, from each internal opening towards the peripheral edge.

8. A packaging item comprising a box, at least one inflatable cushion placed above or below at least one object to be packaged, and at least one other inflatable cushion comprising:

an external peripheral edge adapted to the shape and dimension of the box;

at least one internal opening, each of which is capable of receiving said at least one object to be packaged such that a side of said at least one object is completely encircled by the perimeter of the opening; and a plurality of recesses extending from each internal opening towards the peripheral edge, said recesses delimiting in pairs wedging parts for each internal opening, each of said wedging parts being capable of coming into contact with said at least one object, zones for pivoting being defined between each of said recesses and the peripheral edge, each of said wedging parts being arranged so as to automatically pivot during inflation of said at least one other inflatable cushion about a line extending generally between two successive recesses in order to vary the size and the shape of each internal opening and to adapt each internal opening to objects of different sizes, whilst exerting a holding pressure on said at least one object, said at least one internal opening being completely encircled by said wedging parts.

9. A packaging item according to claim 8, wherein said box includes at least one articulated closure flap, one edge of which is adjacent to a corner of the box, and wherein said at least one other inflatable cushion further comprises a self-sealing inflating valve located in a corner region of said at least one other inflatable cushion, said inflating valve being arranged so that when said at least one other cushion is installed in the box, the inflating valve is accessible through a corner of the box, which enables said at least one inflatable cushion to be inflated from outside the box, even after closing said at least one flap (303), by means of an inflating hose inserted into said inflating valve and passing via a space located between said at least one articulated closure flap and at least one face of the box adjacent to the corner of the box.

10. A packaging item according to claim 9, wherein said inflating valve includes two sheets of flexible plastic welded together adjacent to but spaced apart from their lateral edges.

11. A packaging item according to claim 10, characterized in that the self-sealing inflating valve comprises two thin sheets of flexible plastic which are juxtaposed and welded together along a length so as to form a passage conduit for an inflating hose, said passage conduit being open at both longitudinal ends thereof, said inflating valve being located between two sheets which form said at least one other cushion in the corner region of said at least one other cushion, said inflating valve having a longitudinal end welded to the two sheets which form said at least one other cushion along a bevelled flat defined in the corner region, said inflating valve being welded so as to leave an adjacent opening of the passage conduit which opens to the outside for facilitating insertion of the inflating hose.

12. A packaging item according to claim 11, characterized in that the passage conduit for the inflating hose includes a widening located some distance from a free longitudinal end of said passage conduit, placed inside the cushion.

13. A packaging item according to claim 11, and further comprising two flexible guide tabs for facilitating insertion of said inflating hose into the passage conduit, said two flexible guide tabs being welded to said at least one other cushion along the bevelled flat and having edges located in a prolongation of adjacent edges of the at least one other cushion.

14. A packaging item comprising a box, and two inflatable cushions, wherein each of said two inflatable cushions comprises:

an external peripheral edge adapted to the shape and dimension of the box;

two rectangular internal openings, each of which is capable of receiving an object to be packaged such that a side of said object is encircled by the perimeter of the opening; and a recess extending from each corner of said rectangular internal openings towards the peripheral edge, said recesses delimiting in pairs four wedging parts for each internal opening, each of said wedging parts being capable of coming into contact with said object, zones for pivoting being defined between each of said recesses and the peripheral edge, each of said wedging parts being able to pivot during inflation of the inflatable cushion about a line extending generally between two successive recesses in order to vary the size and the shape of each internal opening and to adapt each internal opening to objects of different sizes, whilst exerting a holding pressure on said object, said internal openings being completely encircled by said wedging parts;

wherein a wedging part from each of said internal openings defines a central wedging part located between the rectangular internal openings of each inflatable cushion; and wherein each of said inflatable cushions can be inflated and arranged such that the four wedging parts associated with each opening pivot and engage a respective lateral surface of the object to be packaged.

15. A packaging item comprising a box, and two inflatable cushions, wherein each of said two inflatable cushions comprises:

an external peripheral edge adapted to the shape and dimension of the box;

two elongated internal openings, each of which is capable of receiving an edge of an object to be packaged;

a recess extending from each longitudinal end of said elongated internal openings towards the peripheral edge, said recesses delimiting in pairs a wedging part for each internal opening, each of said wedging parts being capable of coming into contact with said object, zones for pivoting being defined between each of said recesses and the peripheral edge, each of said wedging parts being able to pivot during inflation of the inflatable cushion about a line extending generally between two successive recesses in order to vary the size and the shape of each internal opening and to adapt each internal opening to objects of different sizes, whilst exerting a holding pressure on said object, said internal openings being completely encircled by said wedging parts; and a fixed central wedging part defined between the two elongated internal openings of each inflatable cushion;

said elongated internal openings being arranged with respect to one another so that a first one of said inflatable cushions can be positioned, in the inflated state, under the object to be packaged in such a manner that the fixed central wedging part engages a lower face of the object, while the wedging parts delimited by the recesses pivot so as to engage two opposing lateral faces of the object to be packaged and so that two lower edges of the object are respectively received in said two elongated internal openings; and wherein said elongated internal openings being further arranged so that the second one of said inflatable cushions can be positioned, in the inflated or semi-inflated state, above the object to be packaged in such a manner that the fixed central wedging part thereof engages an upper face of the object, while the wedging parts delimited by the recesses pivot so as to engage two other opposing lateral faces of the object and so that two upper edges of the object are respectively received in said two elongated internal openings of said second one of the inflatable cushions.

16. A packaging item according to claim 15, characterized in that said two inflatable cushions include at least one central hole produced by cutting two sheets which form each of said two inflatable cushions and by welding together the cut edges of said two sheets.

* * * * *